US011079697B2

(12) United States Patent
Morimoto et al.

(10) Patent No.: US 11,079,697 B2
(45) Date of Patent: Aug. 3, 2021

(54) IMAGE FORMING APPARATUS CAPABLE OF PROMPTING FOR REPLACEMENT OF AT LEAST ONE OF A CHARGING ROLLER AND A CLEANING BLADE

(71) Applicant: KYOCERA Document Solutions Inc., Osaka (JP)

(72) Inventors: Kanako Morimoto, Osaka (JP); Tamotsu Shimizu, Osaka (JP); Kazunori Tanaka, Osaka (JP); Hiroka Itani, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/126,127

(22) Filed: Dec. 18, 2020

(65) Prior Publication Data

US 2021/0200112 A1 Jul. 1, 2021

(30) Foreign Application Priority Data

Dec. 25, 2019 (JP) ..... JP2019-234901

(51) Int. Cl.
*G03G 15/00* (2006.01)
*G03G 15/02* (2006.01)
*G03G 21/00* (2006.01)

(52) U.S. Cl.
CPC ..... *G03G 15/0225* (2013.01); *G03G 21/0011* (2013.01)

(58) Field of Classification Search
CPC ..... G03G 15/0266; G03G 15/553; G03G 21/0011
USPC ..... 399/31, 34
See application file for complete search history.

(56) References Cited

U.S. PATENT DOCUMENTS 10,095,173 B2 * 10/2018 Kinai ..... G03G 15/553
2020/0041949 A1 * 2/2020 Ishino et al. ..... G03G 21/0011

FOREIGN PATENT DOCUMENTS

JP H09-179385 7/1997

* cited by examiner

*Primary Examiner* — William J Royer
(74) *Attorney, Agent, or Firm* — Lex IP Meister, PLLC

(57) ABSTRACT

According to one embodiment, an image forming apparatus includes an image forming portion, and a control portion. The image forming portion includes an image carrier, a charging device, and a cleaning device. The charging device includes a charging roller which contacts a surface of the image carrier. The cleaning device includes a cleaning blade, and an adjustment portion. The cleaning blade slidably contacts the surface of the image carrier. The adjustment portion adjusts a linear pressure of the cleaning blade exerted on the surface of the image carrier. The control portion executes, when a rate of increase of an outer layer resistance value of the charging roller caused by a decrease in the function of the cleaning blade is greater than or equal to a first rate, linear pressure adjustment control of controlling the adjustment portion to increase the linear pressure of the cleaning blade.

10 Claims, 5 Drawing Sheets

FIG. 5

| | INITIAL STATE OF CLEANING BLADE | LINEAR PRESSURE ADJUSTMENT FOR CLEANING BLADE | CHARGING ROLLER VOLTAGE CONTROL | TONER | TIME PASSED UNTIL REPLACEMENT DISPLAY WAS SHOWN (HOURS) | WHETHER IMAGE IS DEFECTIVE (AT POINT WHEN 300 HOURS HAVE PASSED) |
|---|---|---|---|---|---|---|
| EXAMPLE 1 | NORMAL | PERFORMED | NOT PERFORMED | DEDICATED PRODUCT | NO DISPLAY SHOWN | ○ |
| EXAMPLE 2 | NORMAL | PERFORMED | NOT PERFORMED | NON-DEDICATED PRODUCT | 600 | △ |
| EXAMPLE 3 | LEFT AT HIGH TEMPERATURE | PERFORMED | NOT PERFORMED | DEDICATED PRODUCT | 550 | △ |
| EXAMPLE 4 | LEFT AT HIGH TEMPERATURE | PERFORMED | NOT PERFORMED | NON-DEDICATED PRODUCT | 500 | △ |
| EXAMPLE 5 | NORMAL | PERFORMED | PERFORMED | DEDICATED PRODUCT | NO DISPLAY SHOWN | ○ |
| EXAMPLE 6 | NORMAL | PERFORMED | PERFORMED | NON-DEDICATED PRODUCT | 600 | ○ |
| EXAMPLE 7 | LEFT AT HIGH TEMPERATURE | PERFORMED | PERFORMED | DEDICATED PRODUCT | 550 | ○ |
| EXAMPLE 8 | LEFT AT HIGH TEMPERATURE | PERFORMED | PERFORMED | NON-DEDICATED PRODUCT | 500 | ○ |
| COMPARATIVE EXAMPLE 1 | NORMAL | NOT PERFORMED | NOT PERFORMED | DEDICATED PRODUCT | 500 | △ |
| COMPARATIVE EXAMPLE 2 | NORMAL | NOT PERFORMED | NOT PERFORMED | NON-DEDICATED PRODUCT | 300 | × |
| COMPARATIVE EXAMPLE 3 | LEFT AT HIGH TEMPERATURE | NOT PERFORMED | NOT PERFORMED | DEDICATED PRODUCT | 350 | × |
| COMPARATIVE EXAMPLE 4 | LEFT AT HIGH TEMPERATURE | NOT PERFORMED | NOT PERFORMED | NON-DEDICATED PRODUCT | 100 | – |
| COMPARATIVE EXAMPLE 5 | NORMAL | NOT PERFORMED | PERFORMED | DEDICATED PRODUCT | 500 | △ |
| COMPARATIVE EXAMPLE 6 | NORMAL | NOT PERFORMED | PERFORMED | NON-DEDICATED PRODUCT | 300 | △ |
| COMPARATIVE EXAMPLE 7 | LEFT AT HIGH TEMPERATURE | NOT PERFORMED | PERFORMED | DEDICATED PRODUCT | 350 | △ |

○: HIGH QUALITY
△ : ACCEPTABLE LEVEL
× : POOR QUALITY

IMAGE FORMING APPARATUS CAPABLE OF PROMPTING FOR REPLACEMENT OF AT LEAST ONE OF A CHARGING ROLLER AND A CLEANING BLADE

INCORPORATION BY REFERENCE

This application is based upon, and claims the benefit of priority from, corresponding Japanese Patent Application No. 2019-234901 filed in the Japan Patent Office on Dec. 25, 2019, the entire contents of which are incorporated herein by reference.

BACKGROUND

Field of the Invention

The present disclosure relates to an image forming apparatus.

Description of Related Art

A typical image forming apparatus displays a message prompting for replacement of a charging roller when a resistance value of the charging roller becomes greater than an upper limit value.

SUMMARY

An image forming apparatus according to the present disclosure is provided with an image forming portion, and a control portion which controls the operation of the image forming portion. The image forming portion includes an image carrier, a charging device, an exposure device, a developing device, a transfer device, and a cleaning device. The image carrier includes a photosensitive layer on a surface of the image carrier. The charging device causes the surface of the image carrier to be electrically charged. The exposure device exposes to light the surface of the image carrier electrically charged by the charging device, and forms an electrostatic latent image on the surface of the image carrier. The developing device develops the electrostatic latent image into a toner image by using a developer. The transfer device transfers the toner image from the surface of the image carrier to a transfer-receiving member. The cleaning device cleans the surface of the image carrier. The charging device includes a charging roller which is in contact with the surface of the image carrier. The cleaning device includes a cleaning blade, and an adjustment portion. The cleaning blade slidably contacts the surface of the image carrier. The adjustment portion adjusts a linear pressure of the cleaning blade exerted on the surface of the image carrier. The control portion executes, when a rate of increase of an outer layer resistance value of the charging roller which is caused by a decrease in a function of the cleaning blade is greater than or equal to a first rate, linear pressure adjustment control of controlling the adjustment portion to increase the linear pressure of the cleaning blade exerted on the surface of the image carrier.

BRIEF DESCRIPTION OF THE DRAWINGS

FIG. 5 is a table showing test results of examples and comparative examples.

DETAILED DESCRIPTION

Figure 1:
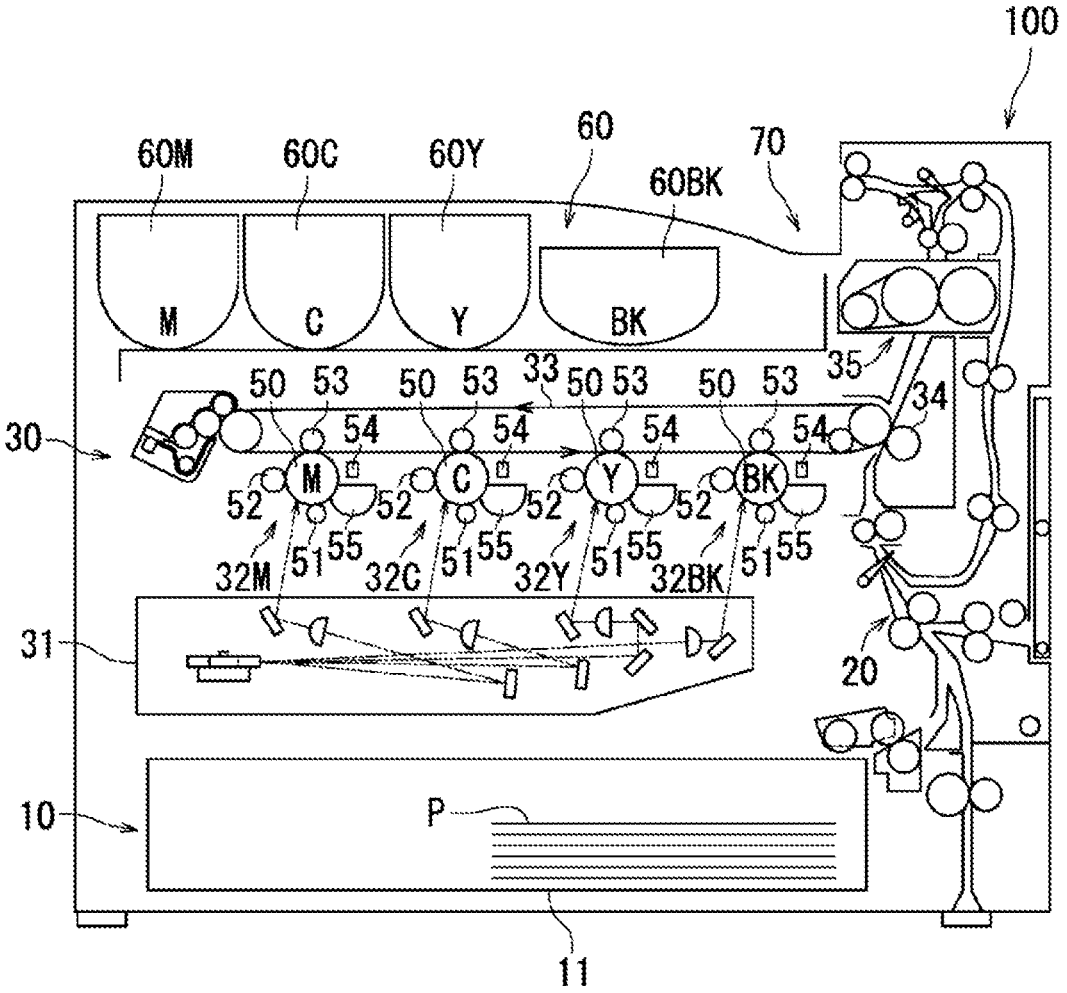
FIG. 1 is a diagram illustrating an example of a configuration of an image forming apparatus according to an embodiment.

Embodiments of the present disclosure will be described below with reference to the accompanying drawings. Note that parts that are the same or equivalent in the drawings are labelled using the same reference symbols, and will not be redundantly described.

First, referring to FIG. 1, a configuration of an image forming apparatus 100 according to an embodiment will be described. FIG. 1 is a diagram illustrating an example of the configuration of the image forming apparatus 100.

As shown in FIG. 1, the image forming apparatus 100 is an electrophotographic full-color printer. The image forming apparatus 100 includes a feeder portion 10, a conveyor portion 20, an image forming portion 30, a toner supply portion 60, and a discharge portion 70.

The feeder portion 10 includes a cassette 11 which accommodates a plurality of sheets P. The feeder portion 10 feeds the sheet P to the conveyor portion 20 from the cassette 11. The sheet P is made from paper or synthetic resin, for example. The conveyor portion 20 conveys the sheet P to the image forming portion 30.

The image forming portion 30 includes an exposure device 31, a magenta (M) unit 32M, a cyan (C) unit 32C, a yellow (Y) unit 32Y, a black (BK) unit 32BK, an intermediate transfer belt 33, a secondary transfer roller 34, and a fixing device 35. Each of the M unit 32M, the C unit 32C, the Y unit 32Y, and the BK unit 32BK includes a photosensitive drum 50, a charging roller 51, a developing roller 52, a primary transfer roller 53, a charge eliminating lamp 54, and a cleaner 55.

The photosensitive drum 50 is a rotating drum which carries an electrostatic latent image and a toner image. The photosensitive drum 50 corresponds to an example of an "image carrier".

The charging roller 51 causes the surface of the photosensitive drum 50 to be electrically charged. The charging roller 51 corresponds to an example of a "charging device".

The exposure device 31 exposes to light the surface of the photosensitive drum 50 electrically charged by the charging roller 51, and forms an electrostatic latent image on the surface of the photosensitive drum 50.

The developing roller 52 develops the electrostatic latent image into a toner image by using a developer. The developing roller 52 corresponds to an example of a "developing device".

The primary transfer roller 53 transfers the toner image from the surface of the photosensitive drum 50 to the intermediate transfer belt 33. The primary transfer roller 53 corresponds to an example of a "transfer device". The intermediate transfer belt 33 corresponds to an example of a "transfer-receiving member".

The charge eliminating lamp 54 eliminates a static charge on the surface of the photosensitive drum 50.

The cleaner 55 cleans the surface of the photosensitive drum 50. The cleaner 55 corresponds to an example of a "cleaning device".

On the external surface of the intermediate transfer belt 33, toner images of four colors are superimposed on one another, and primarily transferred. The toner images of four colors are a magenta toner image, a cyan toner image, a yellow toner image, and a black toner image. The colored toner images are formed on the external surface of the intermediate transfer belt 33 by way of the primary transfer.

The secondary transfer roller 34 secondarily transfers the colored toner images, which are formed on the external surface of the intermediate transfer belt 33, to the sheet P.

The fixing device 35 heats and pressurizes the sheet P to fix the colored toner images onto the sheet P. The sheet P on which the colored toner images are fixed is discharged to the discharge portion 70.

The toner supply portion 60 includes a cartridge 60M for accommodating a magenta toner, a cartridge 60C for accommodating a cyan toner, a cartridge 60Y for accommodating a yellow toner, and a cartridge 60BK for accommodating a black toner. The cartridge 60M, the cartridge 60C, the cartridge 60Y, and the cartridge 60BK supply the toners to the developing rollers 52 of the M unit 32M, the C unit 32C, the Y unit 32Y, and the BK unit 32BK, respectively.

Figure 2:
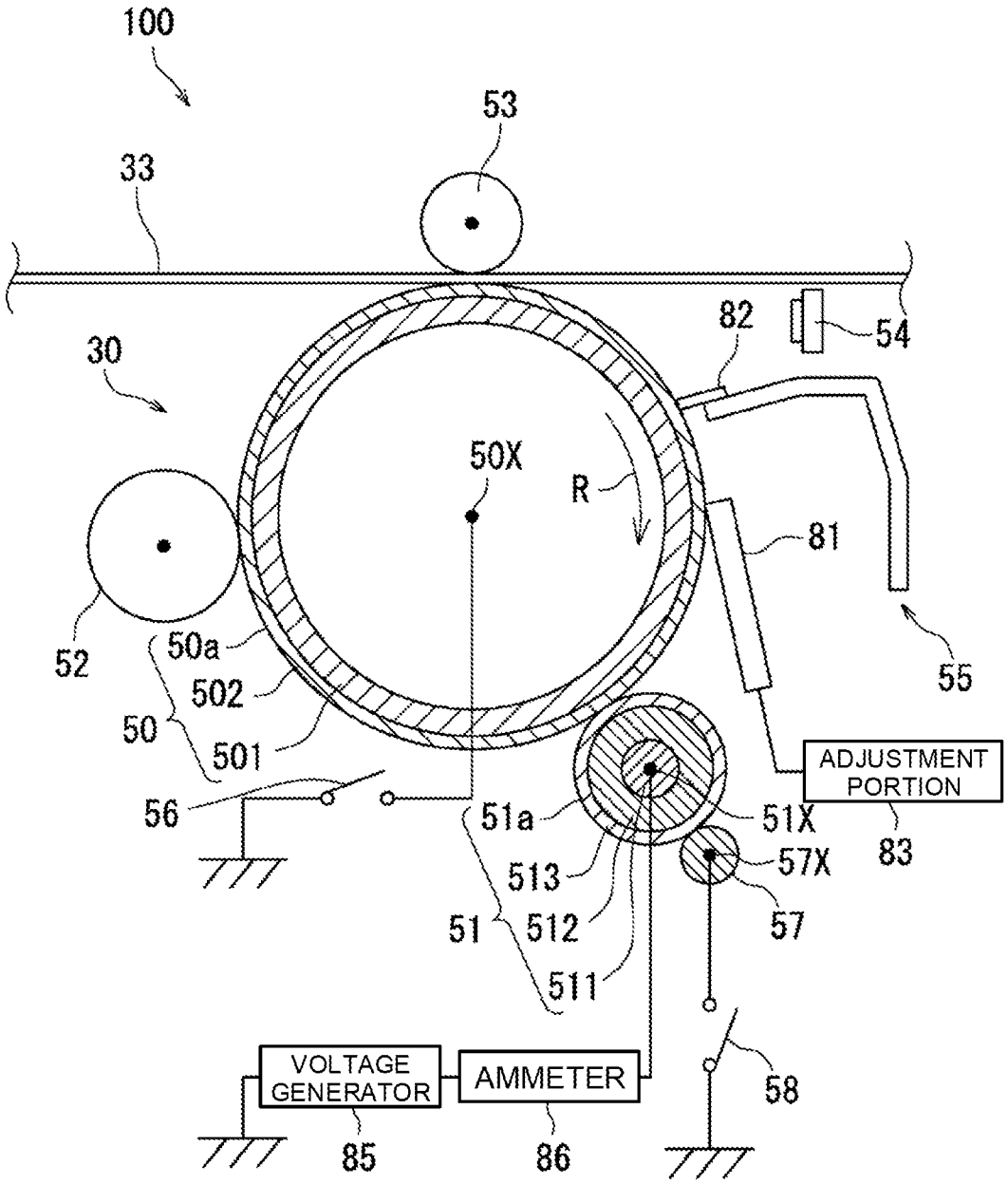
FIG. 2 is an illustration of a photosensitive drum and peripheral parts thereof in an enlarged scale.

Next, the photosensitive drum 50 and peripheral parts of the photosensitive drum 50 will be described with reference to FIGS. 1 and 2. FIG. 2 is an illustration of the photosensitive drum 50 and peripheral parts thereof in an enlarged scale.

As shown in FIG. 2, the image forming portion 30 includes the intermediate transfer belt 33, the photosensitive drum 50, the charging roller 51, the developing roller 52, the primary transfer roller 53, the charge eliminating lamp 54, and the cleaner 55. The image forming apparatus 100 further includes a first switch 56, a contact electrode 57, a second switch 58, a voltage generator 85, and an ammeter 86.

The photosensitive drum 50 includes a conductive base body 501, and a photosensitive layer 502. The surface of the photosensitive layer 502 corresponds to a peripheral surface 50*a* of the photosensitive drum 50. The photosensitive drum 50 rotates about a rotating shaft 50X. Around the photosensitive drum 50, the charging roller 51, the developing roller 52, the primary transfer roller 53, the charge eliminating lamp 54, and the cleaner 55 are arranged in the named order from the upstream side of a rotation direction R of the photosensitive drum 50. The rotating shaft 50X of the photosensitive drum 50 is grounded via the first switch 56.

The cleaner 55 includes a cleaning blade 81, a toner seal 82, and an adjustment portion 83. The cleaning blade 81 slidably contacts the peripheral surface 50*a* of the photosensitive drum 50, and collects the toner remaining on the peripheral surface 50*a* of the photosensitive drum 50. The cleaning blade 81 is made of rubber. The toner seal 82 suppresses scattering of the toner collected by the cleaning blade 81. The adjustment portion 83 adjusts a linear pressure L [N/m] of the cleaning blade 81 exerted on the peripheral surface 50*a* of the photosensitive drum 50.

The charging roller 51 is in contact with the peripheral surface 50*a* of the photosensitive drum 50. The charging roller 51 includes a conductive shaft 511, a base layer 512, and an outer layer 513. The conductive shaft 511 is a metal shaft. The base layer 512 includes a conductive rubber elastic body, and covers the surface of the conductive shaft 511. The outer layer 513 covers the surface of the base layer 512, and serves as a high-resistance coat layer. The surface of the outer layer 513 corresponds to a peripheral surface 51*a* of the charging roller 51. The charging roller 51 rotates about a rotating shaft 51X. The voltage generator 85 and the ammeter 86 are connected to the rotating shaft 51X of the charging roller 51. One end of the voltage generator 85 is grounded.

The contact electrode 57 is in contact with the peripheral surface 51*a* of the charging roller 51. The contact electrode 57 is a shaft-shaped electrode made of metal. The contact electrode 57 rotates about a rotating shaft 57X. The rotating shaft 57X of the contact electrode 57 is grounded via the second switch 58.

Figure 3:
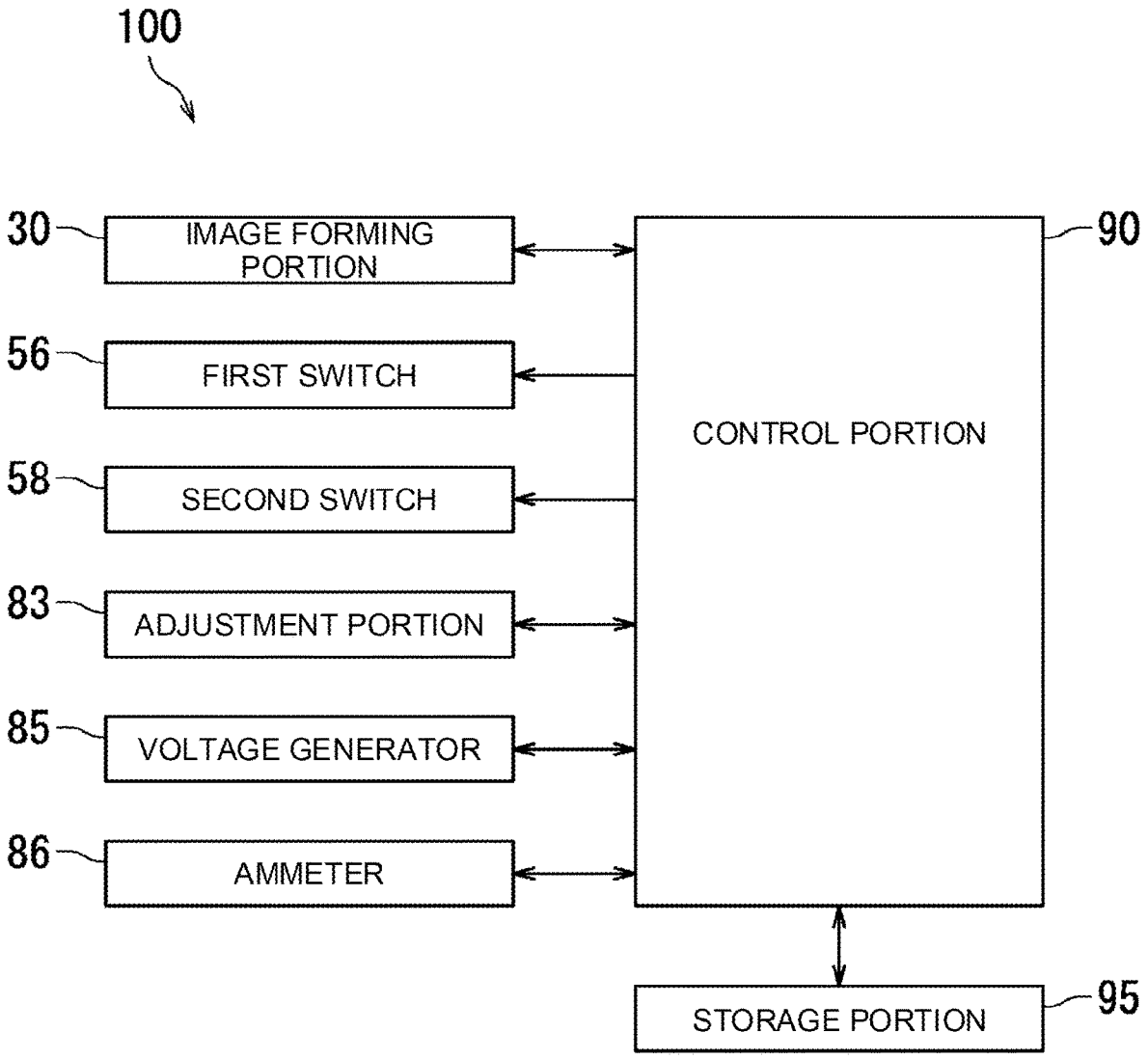
FIG. 3 is a block diagram illustrating an example of a configuration of a control circuit.

Next, a configuration of a control circuit of the image forming apparatus 100 will be described with reference to FIGS. 1 to 3. FIG. 3 is a block diagram illustrating an example of the configuration of the control circuit of the image forming apparatus 100.

As shown in FIG. 3, the image forming apparatus 100 further includes a control portion 90, and a storage portion 95.

The storage portion 95 includes main storage units such as a read-only memory (ROM) and a random-access memory (RAM). The storage portion 95 stores various computer programs, and various kinds of data.

The control portion 90 includes a processor such as a central processing unit (CPU). The control portion 90 executes the computer program stored in the storage portion 95, thereby controlling the operation of respective elements of the image forming apparatus 100. Specifically, the control portion 90 controls the operation of each of the image forming portion 30, the first switch 56, the second switch 58, the adjustment portion 83, the voltage generator 85, and the ammeter 86.

Figure 4:
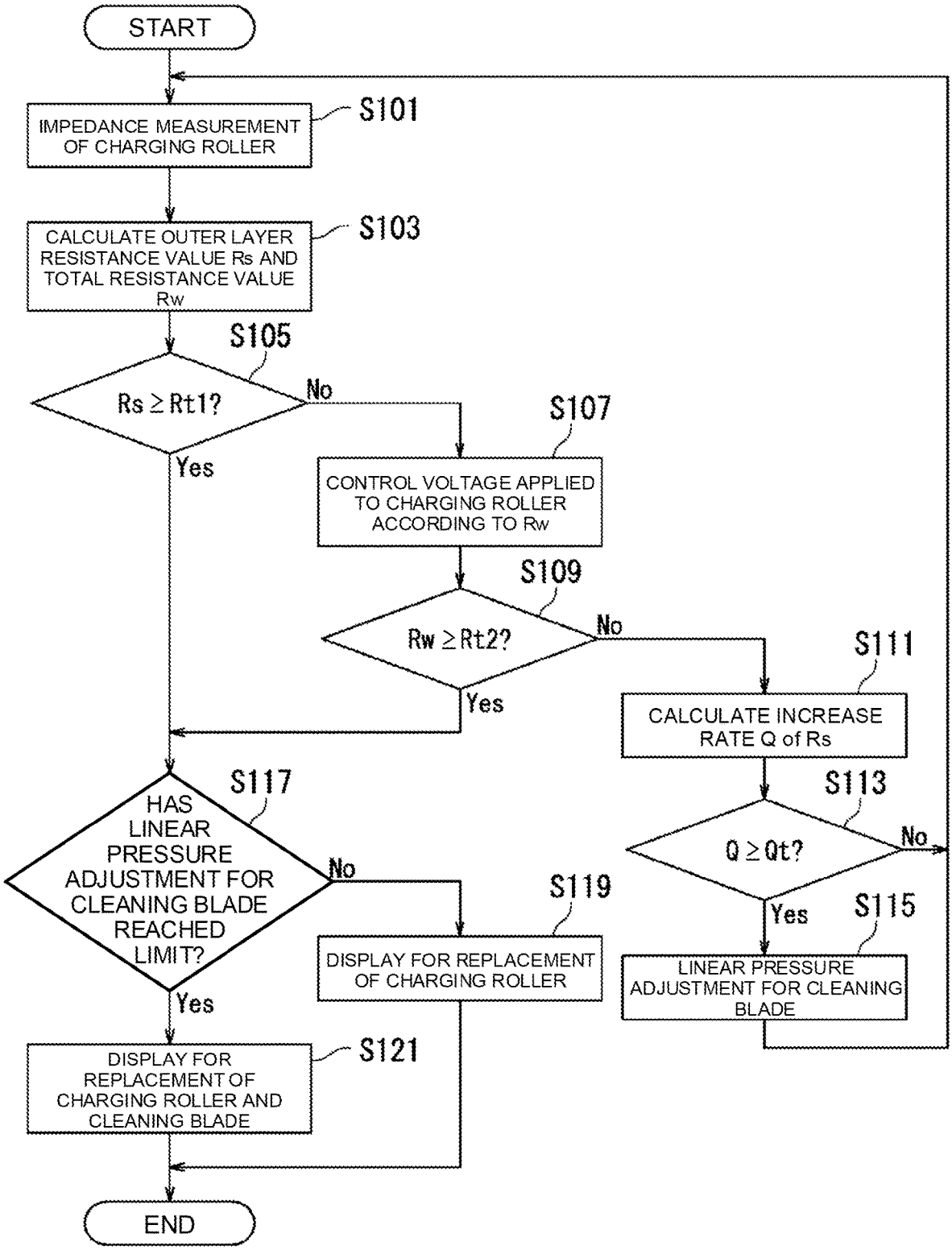
FIG. 4 is a flowchart illustrating an example of processing of a control portion.

Next, processing of the control portion 90 will be described with reference to FIGS. 1 to 4. FIG. 4 is a flowchart illustrating an example of the processing of the control portion 90.

Step S101: As illustrated in FIG. 4, the control portion 90 executes impedance measurement of the charging roller 51 in order to analyze the electrical characteristics of the charging roller 51 by an alternating current impedance method. The impedance measurement is carried out in a state where the photosensitive drum 50, the charging roller 51, and the contact electrode 57 are all kept still at a time when images are not being formed by the image forming portion 30. The control portion 90 turns off the first switch 56, and turns on the second switch 58. Also, the control portion 90 controls the voltage generator 85 such that the voltage generator 85 generates an alternating voltage having a frequency that changes within a specific range, and an amplitude that is constant. The ammeter 86 measures the amplitude and phase of an alternating current that flows through a circuit including the voltage generator 85, the charging roller 51, the contact electrode 57, the second switch 58, and a ground. The control portion 90 acquires information regarding the impedance of the charging roller 51 on the basis of information on the amplitude and the phase of the alternating current obtained by the ammeter 86.

Preferably, a frequency range of the alternating voltage in the impedance measurement should be 1 Hz or more and 100 kHz or less. This is because extraction of the impedance components is enabled in each of a charge transfer process and a mass transfer process within the above-described range. A range of the peak-to-peak amplitude of the alternating voltage should preferably be 1 V or more and 100 V or less. The voltage generator 85 may add a direct-current component to the alternating voltage. A range of the magnitude of the direct-current component should preferably be 1 V or more and 100 V or less. If a voltage to be applied to the charging roller 51 is too low, a signal-to-noise ratio of the impedance measurement is decreased, and if a voltage to be applied to the charging roller 51 is too high, deterioration of the charging roller 51 is accelerated. When the processing of step S101 is complete, the processing of the control portion 90 proceeds to step S103.

Step S103: The control portion 90 calculates an outer layer resistance value Rs [Ω] and a total resistance value Rw [Ω] on the basis of a result of the impedance measurement of the charging roller 51. In order to do this, the control portion 90 fits a Cole-Cole plot graph to an RC parallel equivalent circuit. As a result of the fitting, a base layer resistance value Rb [Ω] is obtained together with the outer layer resistance value Rs. The total resistance value Rw is calculated from the equation Rw=Rs+Rb. For the fitting, a non-linear least-squares method such as the Levenberg-Marquardt (LM) method can be applied. It is possible to obtain better fitting results if Warburg impedance is taken into account. When the processing of step S103 is complete, the processing of the control portion 90 proceeds to step S105.

Step S105: The control portion 90 determines whether the outer layer resistance value Rs is greater than or equal to a first threshold value Rt1 [Ω]. When the control portion 90 determines that the outer layer resistance value Rs is greater than or equal to the first threshold value Rt1 (i.e., "Yes" in step S105), the processing of the control portion 90 proceeds to step S117. When the control portion 90 determines that the outer layer resistance value Rs is smaller than the first threshold value Rt1 (i.e., "No" in step S105), the processing of the control portion 90 proceeds to step S107. The first threshold value Rt1 may be a fixed value that has been set in advance at the time of product shipment, or may be a variable, which is a value to be corrected according to a status of use of the user (such as the temperature and humidity, and the number of prints).

Step S107: The control portion 90 controls a voltage to be applied to the charging roller 51 while an image is being formed by the image forming portion 30, in other words, controls a direct voltage for use in electrically charging the photosensitive drum 50, according to the total resistance value Rw. The direct voltage is applied in a state where the photosensitive drum 50, the charging roller 51, and the contact electrode 57 are all rotating. The control portion 90 turns on the first switch 56, and turns off the second switch 58. Moreover, the control portion 90 controls the voltage generator 85 such that the voltage generator 85 generates a direct voltage of specific magnitude. The direct voltage is set to have a higher value as the total resistance value Rw increases. The voltage generator 85 may generate a voltage produced by superimposing an alternating voltage on a direct voltage.

If the total resistance value Rw of the charging roller 51 increases, a current supplied to the photosensitive drum 50 decreases even if a voltage applied to the charging roller 51 is the same. When the current supplied to the photosensitive drum 50 decreases, the photosensitive drum 50 cannot be electrically charged enough, and image defects such as density defects and density unevenness may be caused. Hence, good image quality can be maintained by control of the voltage applied to the charging roller 51 according to the total resistance value Rw of the charging roller 51. When the processing of step S107 is complete, the processing of the control portion 90 proceeds to step S109.

Step S109: The control portion 90 determines whether the total resistance value Rw is greater than or equal to a second threshold value Rt2 [Ω]. When the control portion 90 determines that the total resistance value Rw is greater than or equal to the second threshold value Rt2 (i.e., "Yes" in step S109), the processing of the control portion 90 proceeds to step S117. When the control portion 90 determines that the total resistance value Rw is smaller than the second threshold value Rt2 (i.e., "No" in step S109), the processing of the control portion 90 proceeds to step S111. The second threshold value Rt2 may be a fixed value that has been set in advance at the time of product shipment, or may be a variable, which is a value to be corrected according to a status of use of the user (such as the temperature and humidity, and the number of prints).

Step S111: The control portion 90 calculates an increase rate Q [Ω/hour] of the outer layer resistance value Rs. The increase rate Q is an increment of the outer layer resistance value Rs per unit time. When the function of the cleaning blade 81 is decreased, contamination of the charging roller 51 accelerates. Therefore, the increase rate Q increases as a result of the decrease in the function of the cleaning blade 81. When the processing of step S111 is complete, the processing of the control portion 90 proceeds to step S113.

Step S113: The control portion 90 determines whether the increase rate Q is greater than or equal to a first rate Qt [Ω/hour]. When the control portion 90 determines that the increase rate Q is greater than or equal to the first rate Qt (i.e., "Yes" in step S113), the processing of the control portion 90 proceeds to step S115. When the control portion 90 determines that the increase rate Q is smaller than the first rate Qt (i.e., "No" in step S113), the processing of the control portion 90 returns to step S101. The first rate Qt is set to, for example, 1.5 times the increase rate Q of the outer layer resistance value Rs to be obtained when the cleaning blade 81 exhibits no decrease in the function.

Step S115: The control portion 90 executes linear pressure adjustment control to control the adjustment portion 83 for adjusting the linear pressure of the cleaning blade 81. The adjustment portion 83 adjusts the linear pressure L of the cleaning blade 81 exerted on the peripheral surface 50*a* of the photosensitive drum 50 such that the amount of bite of the cleaning blade 81 into the photosensitive drum 50 is increased in accordance with the increase in the increase rate Q of the outer layer resistance value Rs.

An edge of the cleaning blade 81 is constantly in contact with the peripheral surface 50*a* of the photosensitive drum 50. In particular, if the cleaning blade 81 is left in a high-temperature environment for a long time, the rubber constituting the cleaning blade 81 may become inelastic early. As a result, the function of the cleaning blade 81 is decreased, and external additive and the like, of the toner slips past more easily. Also, when an externally prescribed non-dedicated toner is used, the decrease in the function of the cleaning blade 81 is accelerated. Therefore, as the control portion 90 executes the linear pressure adjustment control for the cleaning blade 81, the decrease in the function of the cleaning blade 81 is compensated. Accordingly, it becomes possible to prevent the life of the charging roller 51 from becoming short as compared to a case where the decrease in the function of the cleaning blade 81 continues. When the processing of step S115 is complete, the processing of the control portion 90 returns to step S101.

Step S117: The control portion 90 determines whether the linear pressure adjustment for the cleaning blade 81 has reached a limit according to, for example, the number of times of execution of the linear pressure adjustment for the cleaning blade 81 in step S115. When the control portion 90 determines that the linear pressure adjustment for the cleaning blade 81 has reached the limit (i.e., "Yes" in step S117), the processing of the control portion 90 proceeds to step S121. When the control portion 90 determines that the linear pressure adjustment for the cleaning blade 81 has not yet reached the limit (i.e., "No" in step S117), the processing of the control portion 90 proceeds to step S119.

Step S119: The control portion 90 outputs a display prompting for replacement of the charging roller 51. The output display is presented to the user via a liquid crystal display which is not illustrated. When the processing of step S119 is complete, the processing of the control portion 90 is ended.

Step S121: The control portion 90 outputs a display prompting for replacement of the charging roller 51 and the cleaning blade 81. The output display is presented to the user via a liquid crystal display which is not illustrated. When the processing of step S121 is complete, the processing of the control portion 90 is ended.

According to the embodiment, it is possible to provide the image forming apparatus 100 capable of preventing shortening of the life of the charging roller 51.

EXAMPLES

The present disclosure will be further described with reference to examples below. Note that the present disclosure is in no way limited to the scope of the examples.

FIG. 5 is a table showing test results of Examples 1 to 8 and Comparative Examples 1 to 7.

(Energization Test)

The charging roller was dependently rotated by the photosensitive drum at a rotation linear velocity of 250 mm/sec, while the contact electrode was made to contact the charging roller. The charging roller was connected to a direct-current power supply which supplies a constant current of 120 μA, and electrical conduction aging was performed at a printing rate of 20% for each color.

(Alternating Current Impedance Method)

Current data corresponding to five cycles of the current were acquired for each frequency in the impedance measurement of the charging roller, and an effective current value and a current phase were measured. A voltage in the impedance measurement was that corresponding to DC 5V+AC 1V. An angular frequency to in the impedance measurement was that represented as $10^n$[Hz] (where n is equal to 1, 1.2, 1.4, . . . , 5). The LM method was used as the fitting method. Calculation was finished at the point when the number of repeated arithmetic operations of the fitting reached 100, and a parameter estimated value was determined.

(Method for Determining Decrease in Cleaning Blade Function)

From the outer layer resistance value Rs calculated by means of the fitting, the increase rate Q of the outer layer resistance value Rs was calculated. When the increase rate Q is increased to be greater than or equal to 1.5 times that at the normal time, it is determined that the function of the cleaning blade has decreased. For each elapse of 50 hours as the energization time, the decrease in the function of the cleaning blade was determined. In the case of performing the linear pressure adjustment, the linear pressure L of the cleaning blade was increased by the method described in step S115. Then, time passed until a replacement display was evaluated (see FIG. 5), on the basis of the flowchart shown in FIG. 4.

(Image Evaluation Method)

A halftone image was formed on a sheet at the point when 300 hours have passed as the energization time. The halftone image was observed by visual inspection, and the level of image defect caused by nonuniform charging was evaluated (see FIG. 5).

Example 1

Photoreceptor: Amorphous silicon drum

Charging roller: Epichlorohydrin rubber (base layer main component) with quaternary ammonium salt (ionic conductive agent)

Cleaning blade: Urethane rubber

Contact electrode: SUS roller

Initial state of cleaning blade: Normal

Linear pressure adjustment for cleaning blade: Performed

Charging roller voltage control: Not performed

Toner: Dedicated product

Example 2

Example 2 differs from Example 1 in that a non-dedicated toner was used.

Example 3

Example 3 differs from Example 1 in that the initial state of the cleaning blade corresponds to a state of being "left at a high temperature". The above state, i.e., "left at a high temperature", is intended as a state in which a normal cleaning blade is left in a high-temperature and high-humidity (38° C., 80% RH) environment for one month while being made to contact the photoreceptor.

Example 4

Example 4 differs from Example 3 in that a non-dedicated toner was used.

Example 5

Example 5 differs from Example 1 in that the charging roller voltage control was performed.

Example 6

Example 6 differs from Example 5 in that a non-dedicated toner was used.

Example 7

Example 7 differs from Example 5 in that the initial state of the cleaning blade corresponds to a state of being left at a high temperature.

Example 8

Example 8 differs from Example 7 in that a non-dedicated toner was used.

Comparative Example 1

Comparative Example 1 differs from Example 1 in that no cleaning blade linear pressure adjustment was performed.

Comparative Example 2

Comparative Example 2 differs from Comparative Example 1 in that a non-dedicated toner was used.

Comparative Example 3

Comparative Example 3 differs from Comparative Example 1 in that the initial state of the cleaning blade corresponds to a state of being left at a high temperature.

Comparative Example 4

Comparative Example 4 differs from Comparative Example 3 in that a non-dedicated toner was used.

Comparative Example 5

Comparative Example 5 differs from Comparative Example 1 in that the charging roller voltage control was performed.

Comparative Example 6

Comparative Example 6 differs from Comparative Example 5 in that a non-dedicated toner was used.

Comparative Example 7

Comparative Example 7 differs from Comparative Example 5 in that the initial state of the cleaning blade corresponds to a state of being left at a high temperature.

According to Examples 1 to 8, as the linear pressure adjustment for the cleaning blade has been performed, time passed until replacement of the charging roller was displayed could be extended as compared to Comparative Examples 1 to 7. Also, according to Examples 5 to 8, by the control of the voltage applied to the charging roller, it has been confirmed that the image quality could be maintained as compared to Examples 1 to 4.

The embodiment and the examples of the present disclosure have been described above with reference to the drawings. However, the present disclosure is not limited to the above embodiment and examples, and may be embodied in various different forms without departing from the gist of the present disclosure. The drawings mainly and schematically illustrate constituent elements of the present disclosure in order to facilitate the understanding thereof. Therefore, the thickness, length, and the number or the like of the constituent elements illustrated in the drawings may be different from those of the actual modes for the sake of convenience of the illustration. In addition, the shape, dimension, etc., of the constituent elements indicated in the above embodiment and examples are merely examples, and no particular limitations are imposed thereon. That is, the constituent elements may be modified variously without substantially departing from the configuration of the present disclosure.

For example, in the embodiment, the image forming apparatus 100 has been described as a full color printer, but is not limited to the above. The image forming apparatus 100 may be any one of a copying machine, a fax machine, and a multifunction peripheral.

Further, in the embodiment, when the determination is "No" in step S105, the control portion 90 is to always execute the processing of step S107 and step S109. However, the processing is not limited to this flow. Whether to execute or not to execute the processing of step S107 and step S109 may be switched according to the user's selection. When the determination is "No" in step S105, the processing of the control portion 90 may directly proceed to step S111.

Further, in the embodiment, the contact electrode 57 has been described as a shaft-shaped metal electrode, but is not limited to the above. That is, the contact electrode 57 may be made of an elastic body such as a rubber or sponge body including a conductive material as a compound. It is also possible to provide the contact electrode 57 made of an elastic body with a function as a cleaning member of the charging roller 51.

The present disclosure is applicable to the field of image forming apparatus.

What is claimed is:

1. An image forming apparatus comprising:

an image forming portion which comprises an image carrier including a photosensitive layer on a surface of the image carrier, a charging device which causes the surface of the image carrier to be electrically charged, an exposure device which exposes to light the surface of the image carrier electrically charged by the charging device, and forms an electrostatic latent image on the surface of the image carrier, a developing device which develops the electrostatic latent image into a toner image by using a developer, a transfer device which transfers the toner image from the surface of the image carrier to a transfer-receiving member, and a cleaning device which cleans the surface of the image carrier; and a control portion which controls an operation of the image forming portion, wherein:

the charging device includes a charging roller which is in contact with the surface of the image carrier;

the cleaning device includes a cleaning blade which slidably contacts the surface of the image carrier, and an adjustment portion which adjusts a linear pressure of the cleaning blade exerted on the surface of the image carrier; and the control portion executes, when a rate of increase of an outer layer resistance value of the charging roller which is caused by a decrease in a function of the cleaning blade is greater than or equal to a first rate, linear pressure adjustment control of controlling the adjustment portion to increase the linear pressure of the cleaning blade exerted on the surface of the image carrier.

2. The image forming apparatus according to claim 1, wherein the charging roller comprises:

a base layer including a conductive elastic body; and an outer layer as a high-resistance coat layer.

3. The image forming apparatus according to claim 1, wherein the cleaning blade is made of rubber.

4. The image forming apparatus according to claim 1, wherein the control portion executes the linear pressure adjustment control on condition that the outer layer resistance value is smaller than a first threshold value.

5. The image forming apparatus according to claim 4, wherein the control portion outputs a display prompting for replacement of the charging roller and the cleaning blade when the outer layer resistance value is not smaller than the first threshold value, and the linear pressure adjustment of the cleaning blade reaches a limit.

6. The image forming apparatus according to claim 1, wherein the control portion calculates the outer layer resistance value based on a result of impedance measurement of the charging roller.

7. The image forming apparatus according to claim 6, wherein the control portion executes the impedance measurement by bringing the charging roller to a halt at a time when image forming by the image forming portion is unexecuted.

8. The image forming apparatus according to claim 1, wherein the control portion controls a voltage to be applied to the charging roller while an image is being formed by the image forming portion according to a total resistance value of the charging roller.

9. The image forming apparatus according to claim 8, wherein the control portion executes the linear pressure adjustment control on condition that the total resistance value is smaller than a second threshold value.

10. The image forming apparatus according to claim 8, wherein the control portion calculates the total resistance value based on a result of impedance measurement of the charging roller.

* * * * *